US012396542B2

(12) United States Patent
Boan et al.

(10) Patent No.: US 12,396,542 B2
(45) Date of Patent: Aug. 26, 2025

(54) WRIST PALETTE AND METHODS FOR MAKING SAME

(71) Applicants: Leigh Boan, Pawleys Island, SC (US); Brana Williams, Surfside Beach, SC (US); Lynda Priester, Murrells Inlet, SC (US)

(72) Inventors: Leigh Boan, Pawleys Island, SC (US); Brana Williams, Surfside Beach, SC (US); Lynda Priester, Murrells Inlet, SC (US)

(73) Assignee: Leigh Boan, Pawleys Island, SC (US)

( * ) Notice: Subject to any disclaimer, the term of this patent is extended or adjusted under 35 U.S.C. 154(b) by 0 days.

(21) Appl. No.: 18/474,491

(22) Filed: Sep. 26, 2023

(65) Prior Publication Data

US 2024/0008622 A1 Jan. 11, 2024

Related U.S. Application Data

(63) Continuation-in-part of application No. 29/838,571, filed on May 13, 2022.

(60) Provisional application No. 63/410,303, filed on Sep. 27, 2022.

(51) Int. Cl.

| | |
|---|---|
| ***A45D 40/18*** | (2006.01) |
| ***A45D 40/22*** | (2006.01) |
| ***A45F 5/02*** | (2006.01) |
| *A45F 5/00* | (2006.01) |

(52) U.S. Cl.

CPC ..... *A45D 40/18* (2013.01); *A45D 40/22* (2013.01); *A45F 5/02* (2013.01); *A45D 2200/05* (2013.01); *A45F 2005/008* (2013.01)

(58) Field of Classification Search

CPC .... A45D 40/18; A45D 40/22; A45D 2200/05; A45F 5/02; A45F 2005/008; A45F 2200/05

See application file for complete search history.

(56) References Cited

U.S. PATENT DOCUMENTS

| | | | | |
|---|---|---|---|---|
| D91,835 | S | 3/1934 | Martin | |
| D240,769 | S | 7/1976 | Boman | |
| 4,659,000 | A * | 4/1987 | Sales | A45F 5/02 224/679 |
| 5,647,151 | A * | 7/1997 | Fantone | G11B 23/0233 |

(Continued)

FOREIGN PATENT DOCUMENTS

| | | |
|---|---|---|
| CH | 701525 | 1/2011 |
| CN | 114259741 | 4/2022 |

(Continued)

OTHER PUBLICATIONS

Xinfeng Gift and Packaging Co., Ltd., Fashionable Sex Custom Lip Shape Cosmetic Gift Packaging Boxes Lipstick Tin Box, https://xinfenggift.en.made-in-china.com/product/xwJnCQz.

(Continued)

*Primary Examiner* — David M Upchurch

(74) *Attorney, Agent, or Firm* — Carlson, Gaskey & Olds, P.C.

(57) ABSTRACT

Described herein are an improved wrist palette, and methods for making same, wherein the wrist palette is aesthetically pleasing, ergonomic, and configured to easily attach to wearable items without requiring a watchband, bracelet, cord, or other similar accoutrement to attach the palette to the wearer.

20 Claims, 31 Drawing Sheets

(56) References Cited

U.S. PATENT DOCUMENTS

| | | | | |
|---|---|---|---|---|
| 8,276,598 | B1 * | 10/2012 | Shepard | A45D 8/20 132/277 |
| D692,784 | S * | 11/2013 | Anderssen | D10/70 |
| D707,957 | S * | 7/2014 | Oas | D3/215 |
| 9,943,159 | B1 | 4/2018 | Novikova | |
| D882,179 | S | 4/2020 | Huang | |
| D919,890 | S * | 5/2021 | Chung | D3/215 |
| 2003/0111497 | A1 * | 6/2003 | Lukaris | B44D 3/12 224/269 |
| 2009/0031757 | A1 | 2/2009 | Harding | |
| 2018/0070712 | A1 * | 3/2018 | Loso | A45F 5/021 |
| 2020/0297098 | A1 * | 9/2020 | Kang | A45C 13/10 |
| 2023/0012753 | A1 * | 1/2023 | Klein | A45F 5/02 |

FOREIGN PATENT DOCUMENTS

| | | |
|---|---|---|
| GB | 702017006014255-0001 | 6/2017 |
| GB | 700009008323398-0001 | 12/2020 |
| JP | H10155541 | 6/1998 |
| KR | 200202791 | 11/2000 |
| KR | 20090002235 | 3/2009 |
| KR | 20090064619 | 6/2009 |

OTHER PUBLICATIONS

Focus Technology Co Ltd, Custom Logo Printing Luxury Cardboard Gloss Lip Shaped Lipstick Packaging Box, https://kexin888.en.made-in-china.com/product/TKCJzndZXopY/China-Custom.

Dongguan Huohang Hardware Co Ltd, Hot Sale Lip Shape Lip Stick Packaging Tin Box Lipstick Tin Container, https://www.alibaba.com/product-detail/Hot-sale-lip-shape-lip-stick_60.

Shanghai Geoto Packaging Co Ltd, Custom Rigid Cardboard Red Empty Lip Shaped Beauty Packaging Box Makeup, https://www.alibaba.com/product-detail/Lip-Shaped-Box-Box-Makeup-Empt.

alibaba.com, Wholesale Lkiss Lip Shape Box Acrylic Lipstick Box, https://www.alibaba.com/product-detail/Wholesale-IKISS-lip-shape-box-acrylic_1600110298792.html?spm=a2700.7724.

alibaba.com, Customized Valentines Day Pink and Red Lip Shape PU Leather Covered Paper Box for Chocolate Dessert Packaging With Factory Price, https://www.alibaba.com/product-.

W7, W7 Kiss Lip Kit Set Lipstick Lip Liner & Gloss in Lip Shaped Tin, https://www.ebay.com/itm/164465778667.

OEM Brand, Custom Lip Shape Lipstick Packaging Paper Box Creative Personality Mini Single Lipstick Cosmetics Gift Box, https://www.alibaba.com/product-detail/Custom-lip-shape-.

* cited by examiner

WRIST PALETTE AND METHODS FOR MAKING SAME

TECHNICAL FIELD

The subject matter disclosed herein is generally directed to an improved wrist palette, and methods for making same, wherein the wrist palette is aesthetically pleasing, ergonomic, and configured to easily attach to wearable items without requiring a watchband, bracelet, cord, or other similar accoutrement to attach the palette to the wearer.

BACKGROUND

Various, wearable applicator and/or cosmetic holders are available on the market.

These include U.S. Pat. No. 9,943,315, Hands-free, refillable, skin ointment applicator, that discloses a hands-free, refillable, skin ointment applicator adapted to be worn on a user's wrist to enable them to rub skin ointment such as lip balm or sun screen on their face without needing to use their hands. The invention also relates to a hands-free comestible holder for dipping the comestible in the user's mouth. See FIG. 1.

Further efforts include combining a cosmetic holder with time pieces, such as watches, see KR200202791, A Case Of Cosmetics For Wearing On Wrist, as well as KR20090002235, Cosmetic Case. See FIG. 2. Additionally, CH701525, Watch Case with Make-Up Specialist, provides a wrist watch case that has a make-up box provided within a housing. A foldable casing cover with a hinge is provided for opening the housing. A recess for a replaceable container containing the make-up equipment, is provided within the housing. The casing cover is formed of metal, glass, plastic or Perspex(®: Polymethylmethacrylate). See FIG. 3.

KR20090064619, A Watch Have [sic] A Cosmetics Container, that also discloses watches combined with a cosmetics case, see FIG. 4. Meanwhile, JPH10155541, Cosmetic Case, provides a portable compact case which can be made into pendant type to be mounted on the wrist, back of hand, arm or to be hung from the neck by attaching a storage vessel for housing articles for make-up or skin care through simple configuration to a string body or band body. CN114259741, Ornament Toys and Coating Material Containment Body, discloses a container that may be attached to a watch band, necklace, or ribbon. See FIG. 5. U.S. Pat. Pub. No. 20090031757, Modular Toy Bracelet, discloses a modular toy bracelet that is easily constructable, interchangeable, lightweight, adjustable, and fashionable. The bracelet comprises a plurality of connecting cases, with each connecting case having a top portion and a bottom portion removably attached at the backside to form an interior cavity when the top portion is closed over the bottom portion. See FIG. 6. U.S. Design Pat. No. D91,835, Toilet Accessory Container, discloses a flattened case with an image of human lips on top of the container. See FIG. 7. U.S. Design Pat. No. D240,769, Container for Cosmetics, discloses a shaped container for holding cosmetics. See FIG. 8. U.S. Design Pat. No. D882,179, Storage Box, shows a new design for a storage box. See FIG. 9.

Other designs include U.S. Pat. No. 20090044825, Cosmetic Holder For Carrying By User, discloses a cosmetic holder includes a mounting base adapted for mounting to an appendage of a user, a plurality of cosmetic containers for storing cosmetics and/or cosmetic accessories, and a swivel joint connected between the mounting base and a selected cosmetic container for adjusting a position of the cosmetic container with respect to the mounting base about three mutually perpendicular axes. See FIG. 10. U.S. Pat. No. 1,777,027, Wrist Vanity Case, discloses a compact or vanity case, which is designed to be worn to simulate a wrist watch or may be worn as a garter or ankle bracelet. See FIG. 11. U.S. Pat. No. 6,189,542 discloses an improved hair clip that employs a pair of cooperating main members that are pivotally connected and biased into a hair engaging orientation. Each of the main members is contoured and includes a first end spaced apart from a second end by a middle portion. The first end of each main member acts as an articulation tab that allows an individual to apply leverage necessary to place the clip in a hair engaging orientation. A mirror is removably attached to the first end of the first main member, and a cosmetics case is removably attached to the first end of the second main member. Attachment sleeves are removably attached to the main member middle portions. Each storage sleeve may be capped for storage of loose items or may accept one of several interchangeable accessory tubes. An included alarm assembly advantageously indicates unwanted attempts to remove the device. See FIG. 12. GB 369302, Improvements Relating to Wristlet Watches, discloses a combined vanity case and wrist watch that comprises a container 2 for toilet accessories and a lid 4 adapted to receive the works of a watch. As shown in the Figure the container 2 has loops 2*a* to receive a wristband 3 and is constructed to receive two pads 2*b*. The base of the container may be formed concave upwards. See FIG. 13. Meanwhile, U.S. Pat. No. 1,714,732, Bracelet-Vanity Case, discloses a vanity case that can be worn as a bracelet. See FIG. 14. KR 101028389, Bracelet Having Makeup Goods, discloses a bracelet having a makeup article that does not need a separate space for storing the makeup article, which can be used easily and conveniently without taking out the makeup article in a separate storage space such as a handbag. See FIG. 15. U.S. Pat. No. 9,867,448, Container with Collapsible Applicator, provides a container that includes a base having a plurality of sides defining a base perimeter configured to hold a product. The container also includes a lid assembly configured to be pivotally coupled to the base and a recess disposed on two or more of the plurality of sides. See FIG. 16. U.S. Pat. Pub. No. 20050022554, Bracelet with Interchangeable Adornments, shows a bracelet with interchangeable adornments for storing medications, hygiene products, or food. The bracelet has a strap and a container, which attaches to the strap via a fastening means. See FIG. 17. U.S. Pat. Pub. No. 20050098592, Personal Article Holder with Dispenser, discloses a personal article holder includes a clamping body with a clamping position and an open position. The clamping body includes an upper arm and a lower arm pivotally connected at one end to a corresponding end of the upper arm such that personal articles may be retained between the upper and lower arm. See FIG. 18. FR 2797692, Watch With A Lipstick Palette Enclosed In A Housing Beneath A Conventional Watch Housing Enabling A User To Have A Ready Lipstick Supply Without Needing To Carry A Separate Lipstick Container, discloses a watch with a first housing (2) for a conventional watch and components and a second housing (3) with openings (3*a*, 3*b*) for lipstick. The second housing is connected to the first so that it can be opened using a hinge (la). See FIG. 19. U.S. Pat. No. 6,002,651, Combination Compact and Watch, illustrates a container which has a watch in a top compartment and cosmetics in a compartment below the watch. The compartment for cosmetics has a removable tray which contains the cosmetics and an applicator, and has a release aperture which makes it convenient to remove the compartment containing the cosmetics in order to change the cosmetics. See FIG. 20. U.S. Pat. No. 6,425,506, Decorative Cosmetic Case, provides a decorative cosmetic case with a container and a cover member pivotally connected to the bottom of the container. The container has a semi-spherical shell with a recessed interior for storing cosmetics, and an annular projection defines the annular edge of a downward opening of the container. See FIG. 21. KR 200316374, Cosmetic Case Having Mobile-Phone, shows a cell phone strap with a combination of hanging cosmetics and toiletries, the cosmetic case is equipped with a mirror. See FIG. 22.

As the above disclosures show, prior efforts require attachment means to affix their various container components to the wearer such as wrist bands, cords, bracelets, etc. This necessitates designing the various devices to accommodate these various attachment means, as well as wishfully hoping for universal attachment capability, which is unlikely, cumbersome, and limits the product design and usefulness. Accordingly, it is an object of the present disclosure to provide an improved wrist palette that is aesthetically pleasing, ergonomic, and configured to easily attach to wearable items without requiring a watchband, bracelet, cord, or other similar accoutrement to attach the palette to the wearer as described and shown herein.

Citation or identification of any document in this application is not an admission that such a document is available as prior art to the present disclosure.

SUMMARY

The above objectives are accomplished according to the present disclosure by providing a wrist palette. The wrist palette may include a shaped outer cover defining at least one first shape, a container attached to and covered by the shaped outer cover, the container defining at least one second shape that is complementary to the at least one first shape defined by the shaped outer cover, the shaped outer cover and the container affixed to one another via at least one hinge and move from a closed position to an open position as well as move from the open position to the closed position, at least one attachment clip affixed to a lower, outer surface of the container, and the at least one attachment clip configured to move from a first position engaging the lower, outer surface of the container to a second position distanced from the lower, outer surface of the container and configured to return to the first position from the second position. Further, the shaped outer cover may be formed in the shape of a stylized human lip. Again, the container may define at least one storage container within the container. Yet again, the storage container may be formed in the same shape as the container. Still yet, the at least one attachment clip may define at least one attachment first chasm between the at least one attachment clip and the lower, outer surface of the container. Moreover, the attachment clip may define a second engagement chasm positioned substantially perpendicular to the first engagement chasm. Further still, the at least one attachment clip may define at least one attachment hook on a distal end of the attachment clip. Still yet, a spring may placed between the at least one attachment clip and the lower, outer surface of the container. Further yet, the spring may be a 'V' shaped spring. Yet still again, the wrist palette may define at least one indention in the shaped outer cover or the container.

In a further embodiment, the disclosure provides a method of forming a wrist palette, The method may include forming a shaped outer cover to define at least one first shape, forming a container attached to and covered by the shaped outer cover, forming the container to define at least one second shape that is complementary to the at least one first shape defined by the shaped outer cover, forming the shaped outer cover and the container affixed to one another via at least one hinge and configuring the shaped outer cover and the container to move from a closed position to an open position as well as move from the open position to the closed position, forming at least one attachment clip and a second position distanced from the lower, outer surface of the container and configured to return to the first position from the second position. Furthermore, the shaped outer cover may be formed in the shape of a stylized human lip. Still further, the container may define at least one storage container within the container. Yet again, the storage container may be formed in the same shape as the container. Yet further, the at least one attachment clip may be formed to define at least one attachment first chasm between the at least one attachment clip and the lower, outer surface of the container. Further again, the attachment clip may be formed to define a second engagement chasm positioned substantially perpendicular to the first engagement chasm. Still yet further, the at least one attachment clip may be formed to define at least one attachment hook on a distal end of the attachment clip. Still yet again, a spring may be placed between the at least one attachment clip and the lower, outer surface of the container. Further still, the spring may be a 'V' shaped spring. Again, wrist palette may be formed to define at least one indention in the shaped outer cover or the container.

These and other aspects, objects, features, and advantages of the example embodiments will become apparent to those having ordinary skill in the art upon consideration of the following detailed description of example embodiments.

BRIEF DESCRIPTION OF THE DRAWINGS

An understanding of the features and advantages of the present disclosure will be obtained by reference to the following detailed description that sets forth illustrative embodiments, in which the principles of the disclosure may be utilized, and the accompanying drawings of which.

Figure 1:
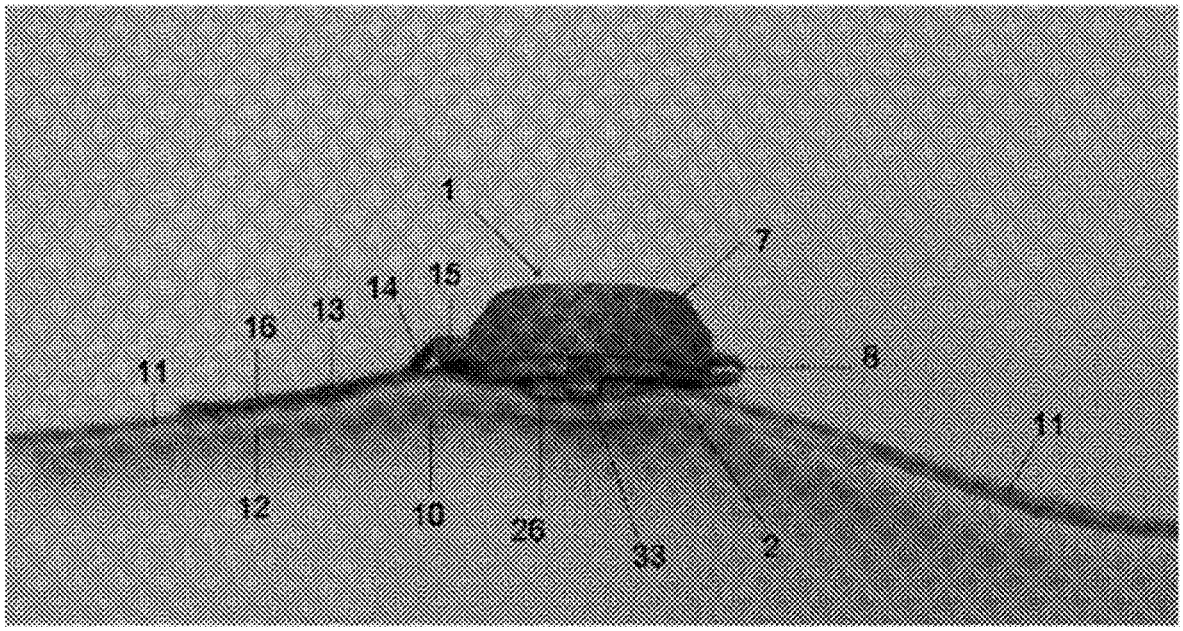
FIG. 1 Prior Art
FIG. 1 shows a prior art construct.
Figure 2:
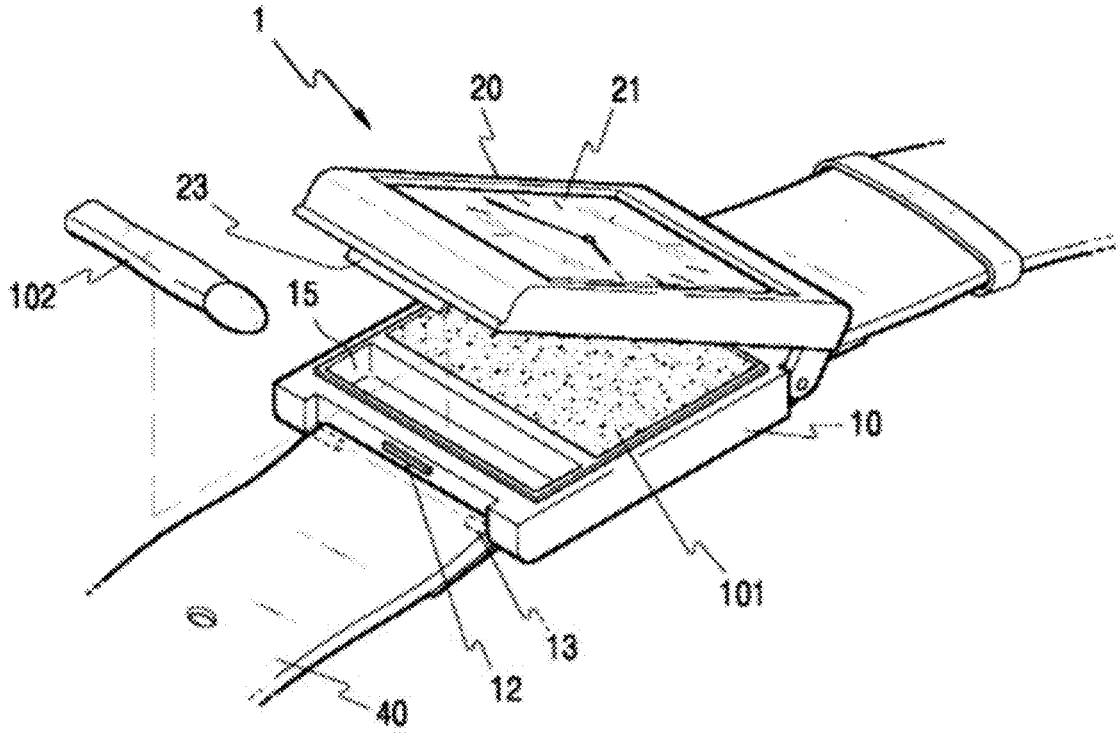
FIG. 2 Prior Art
FIG. 2 shows another prior art construct.
Figure 3:
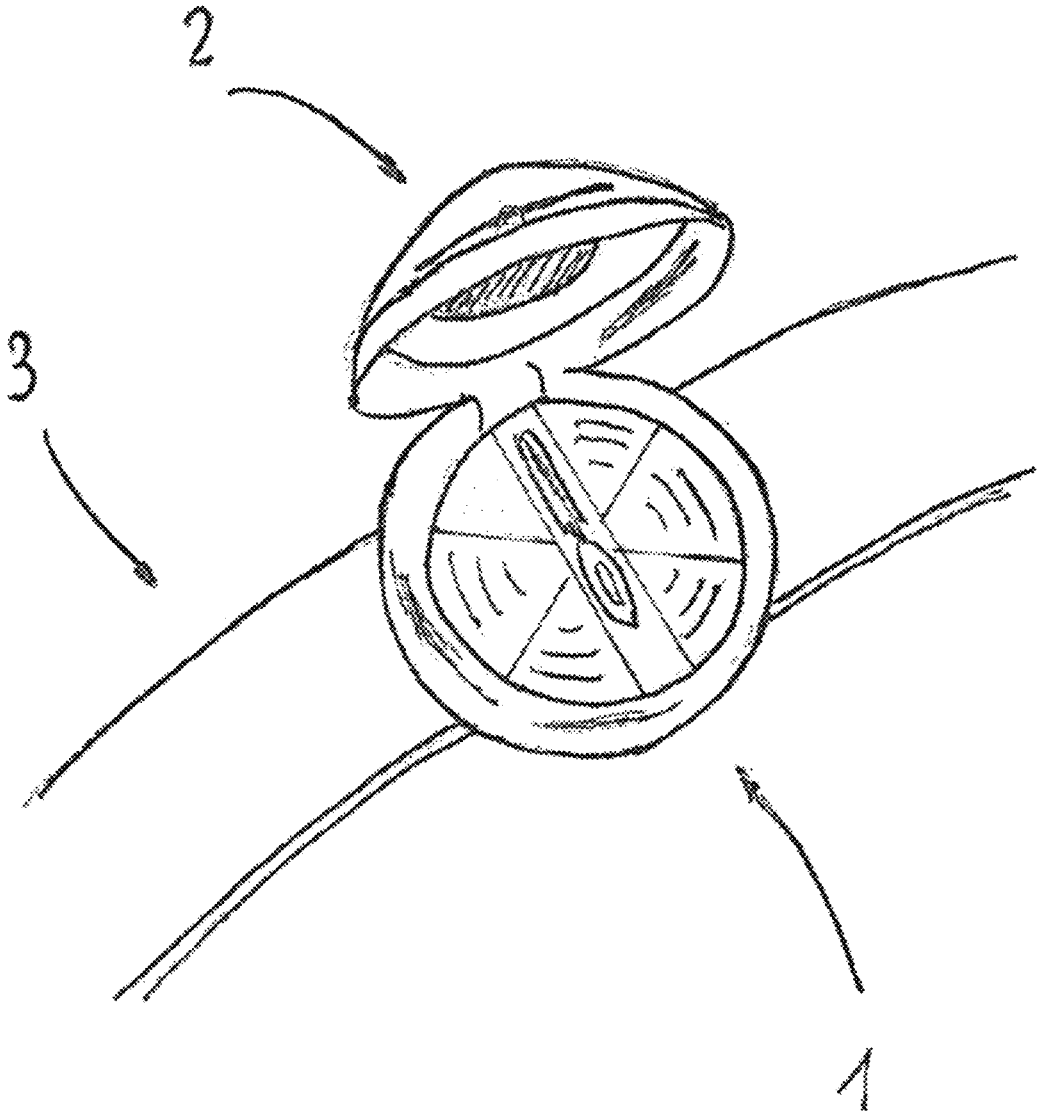
FIG. 3 Prior Art
FIG. 3 shows yet another prior art construct.
Figure 4:
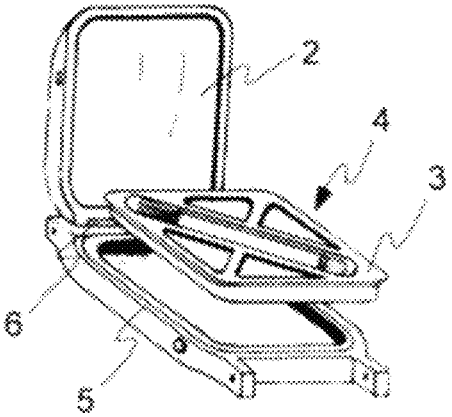
FIG. 4 Prior Art
FIG. 4 shows yet another prior art construct.
Figure 5:
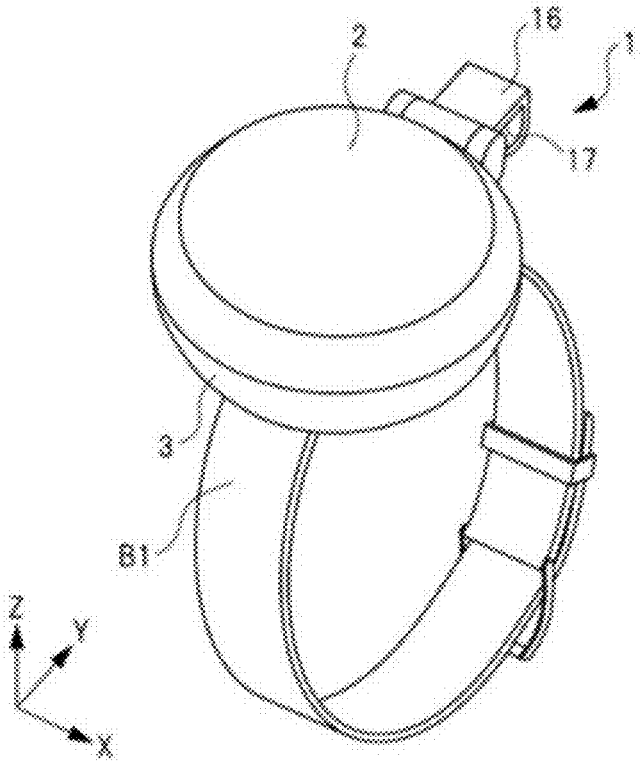
FIG. 5 Prior Art
FIG. 5 shows yet another prior art construct.
Figure 6:
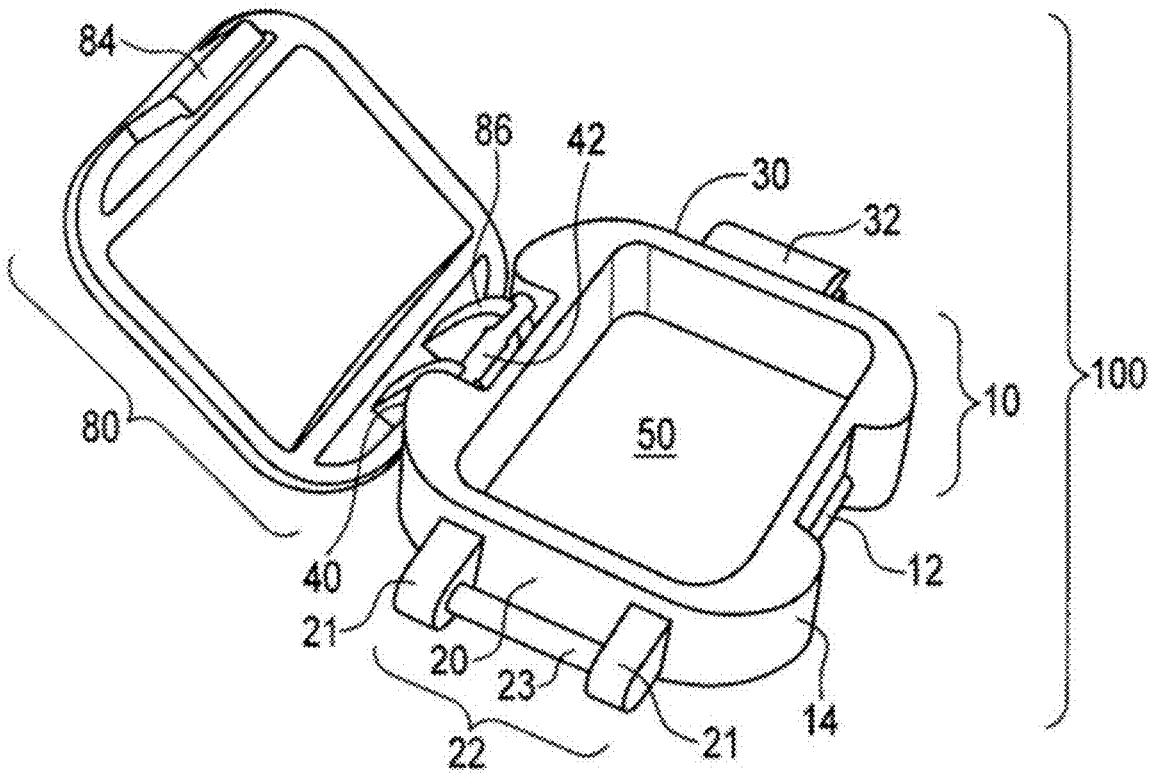
FIG. 6 Prior Art
FIG. 6 shows yet another prior art construct.
Figure 7:
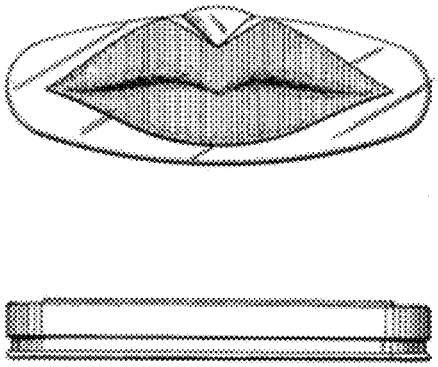
FIG. 7 Prior Art
FIG. 7 shows yet another prior art construct.
Figure 8:
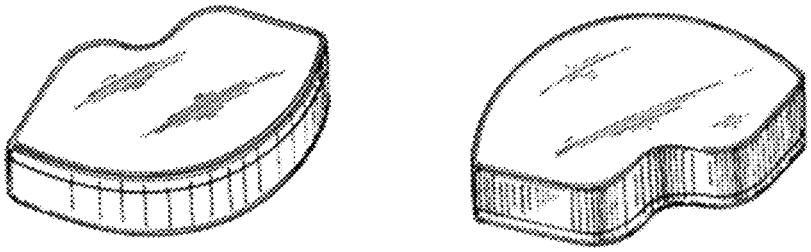
FIG. 8 Prior Art
FIG. 8 shows yet another prior art construct.
Figure 9:
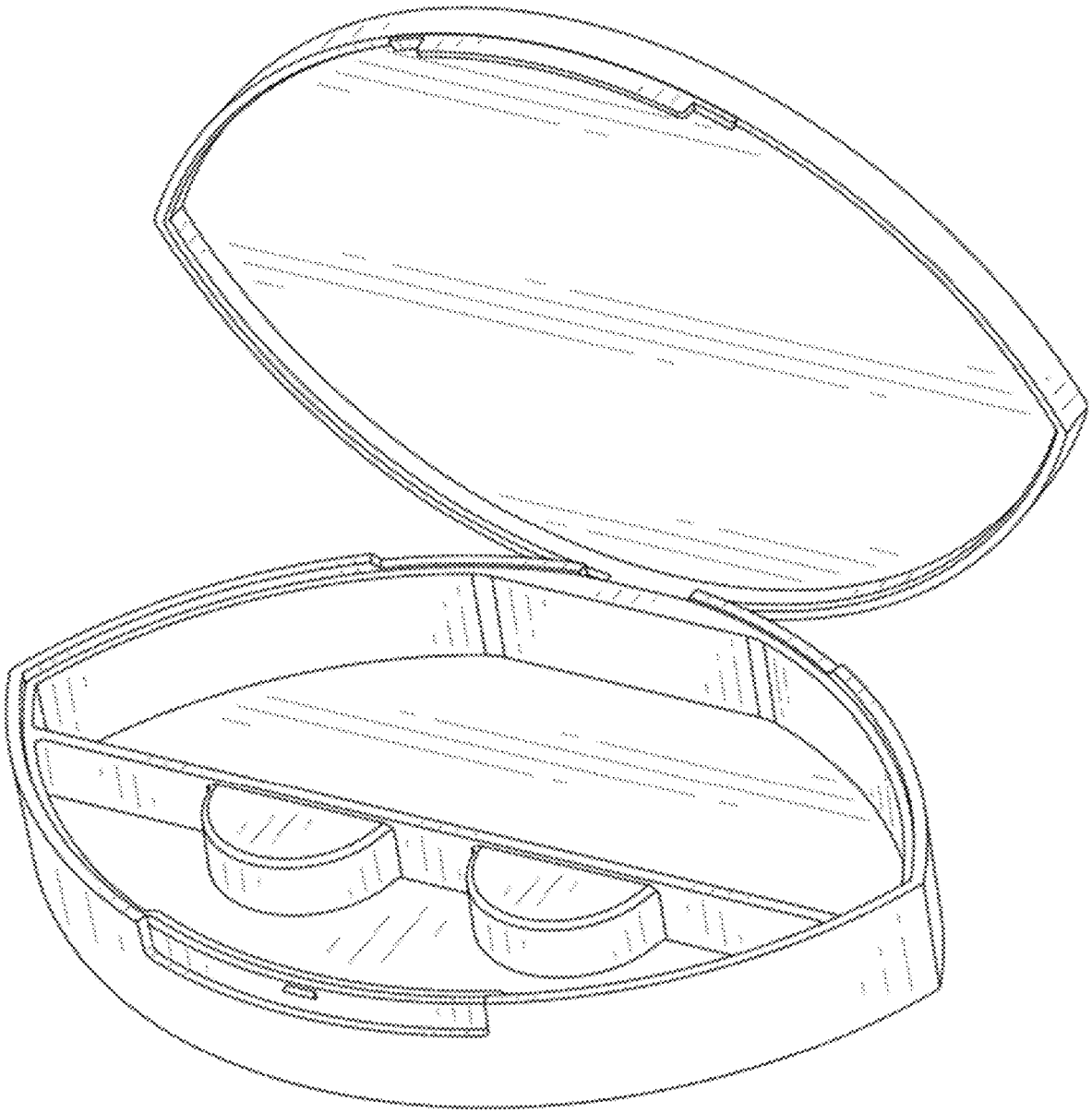
FIG. 9 Prior Art
FIG. 9 shows yet another prior art construct.
Figure 10:
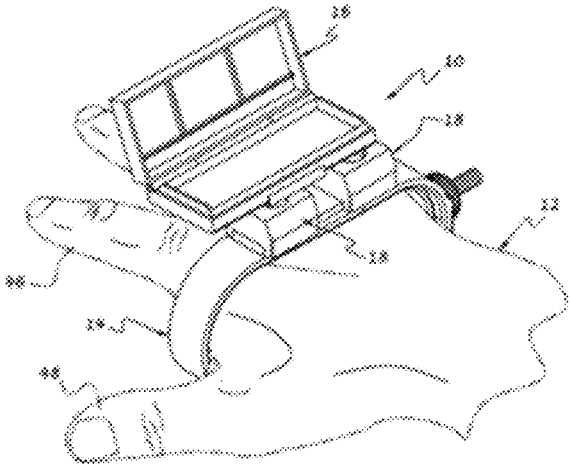
FIG. 10 Prior Art
FIG. 10 shows yet another prior art construct.
Figure 11:
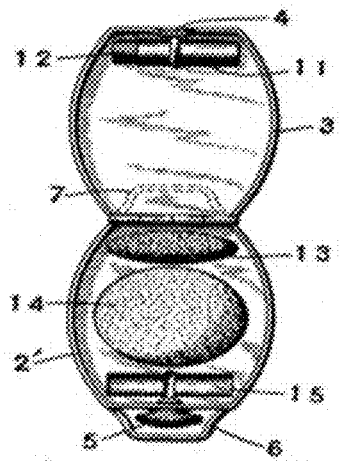
FIG. 11 Prior Art
FIG. 11 shows yet another prior art construct.
Figure 12:
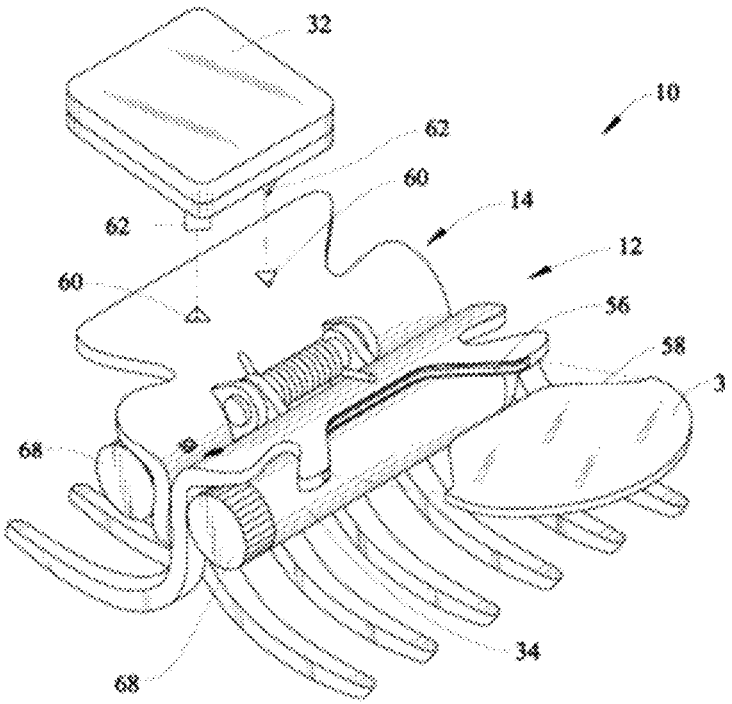
FIG. 12 Prior Art
FIG. 12 shows yet another prior art construct.
Figure 13:
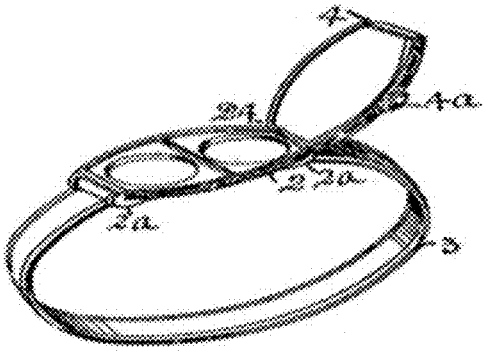
FIG. 13 Prior Art
FIG. 13 shows yet another prior art construct.
Figure 14:
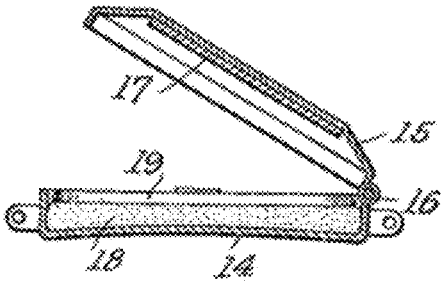
FIG. 14 Prior Art
FIG. 14 shows yet another prior art construct.
Figure 15:
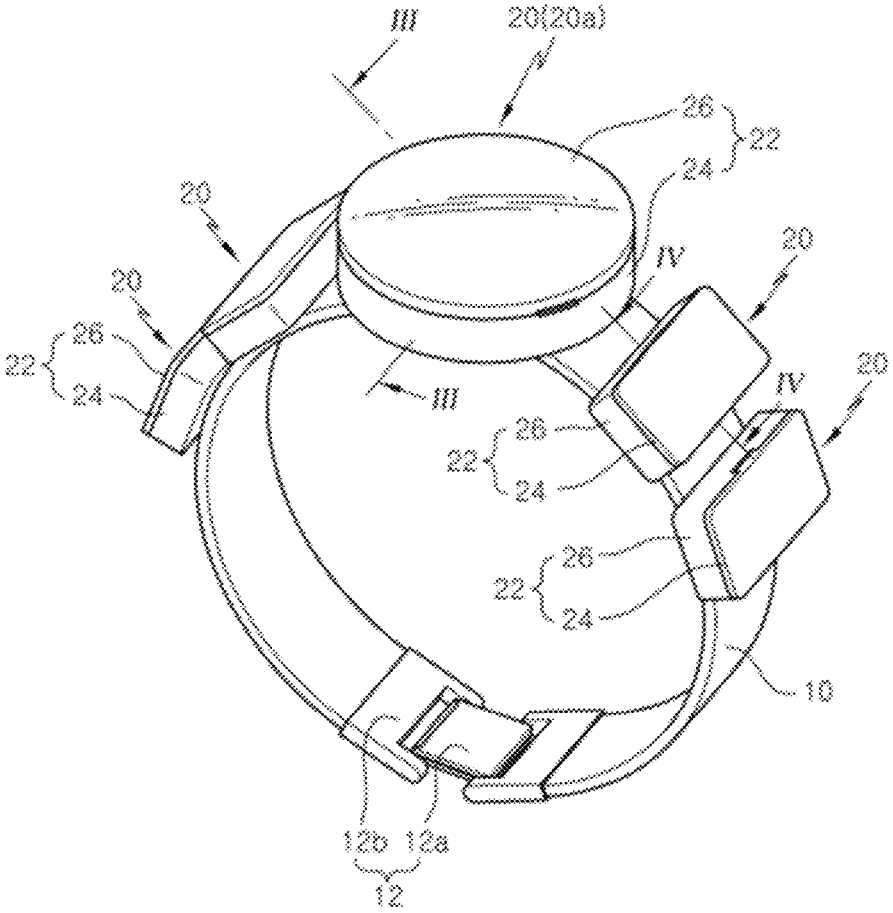
FIG. 15 Prior Art
FIG. 15 shows yet another prior art construct.
Figure 16:
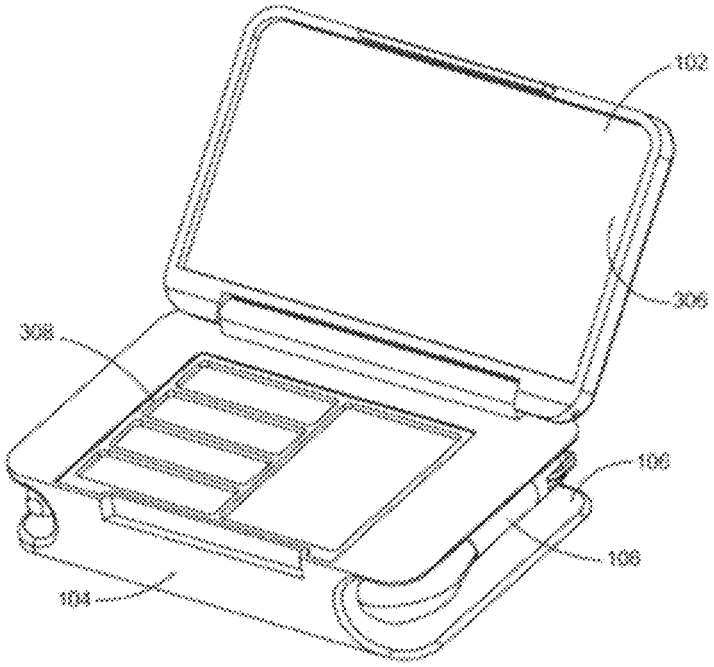
FIG. 16 Prior Art
FIG. 16 shows yet another prior art construct.
Figure 17:
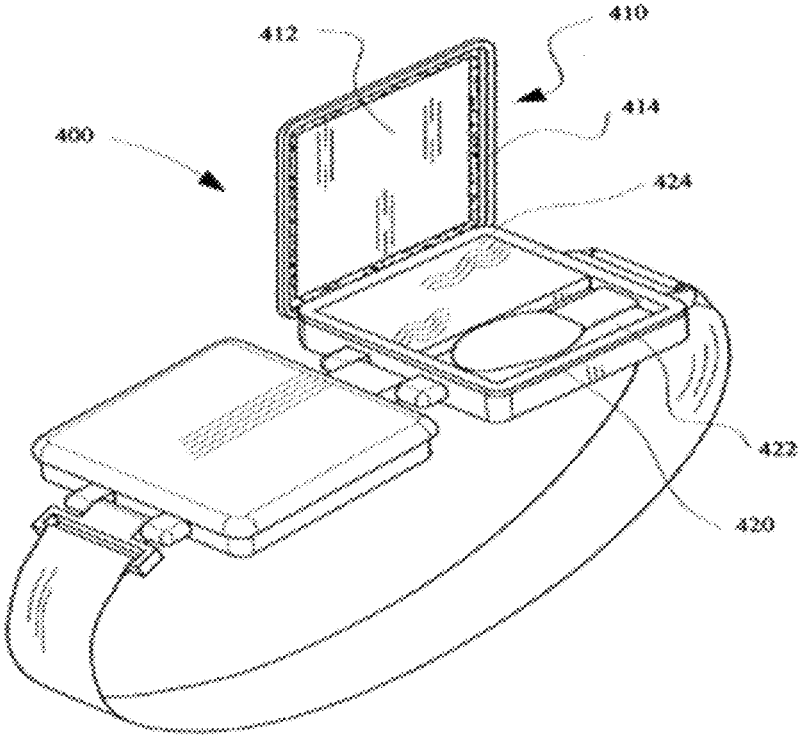
FIG. 17 Prior Art
FIG. 17 shows yet another prior art construct.
Figure 18:
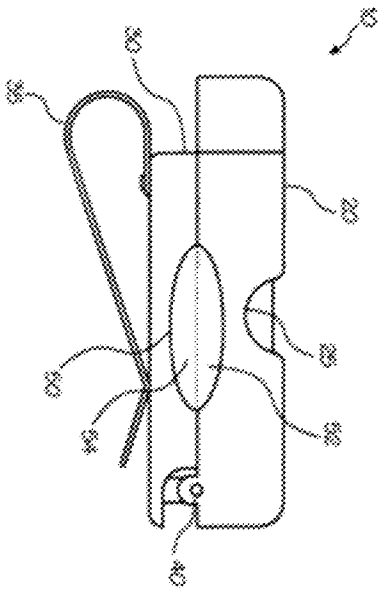
FIG. 18 Prior Art
FIG. 18 shows yet another prior art construct.
Figure 19:
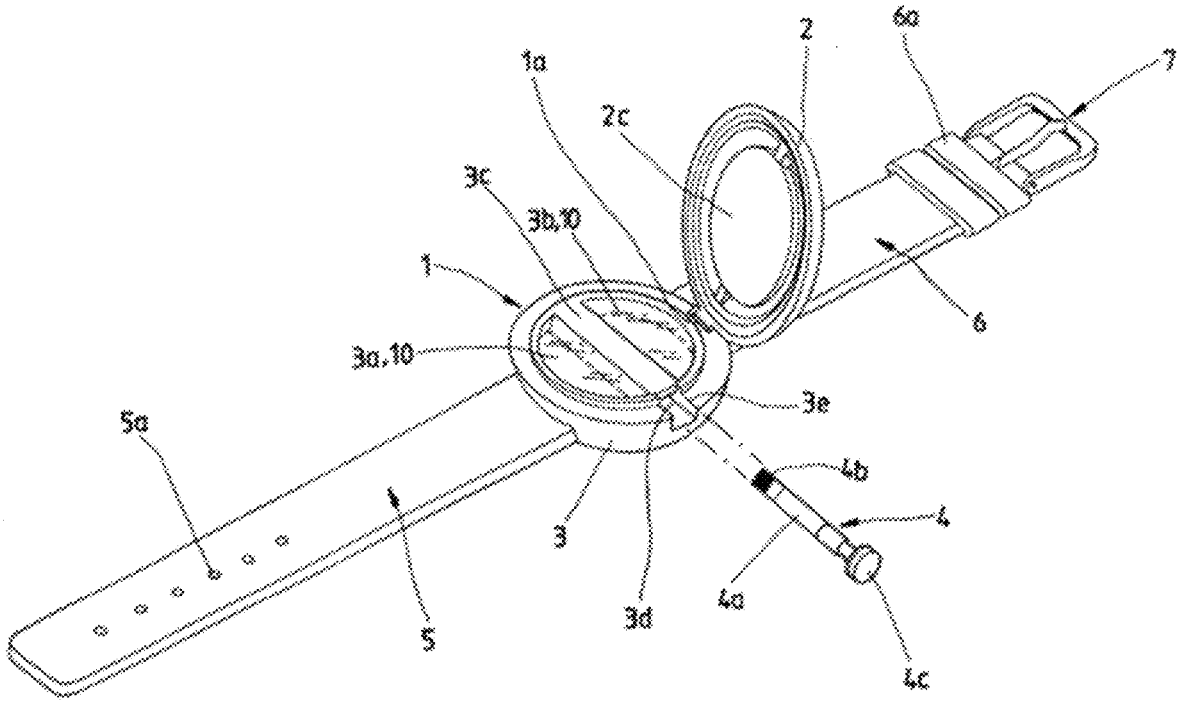
FIG. 19 Prior Art
FIG. 19 shows yet another prior art construct.
Figure 20:
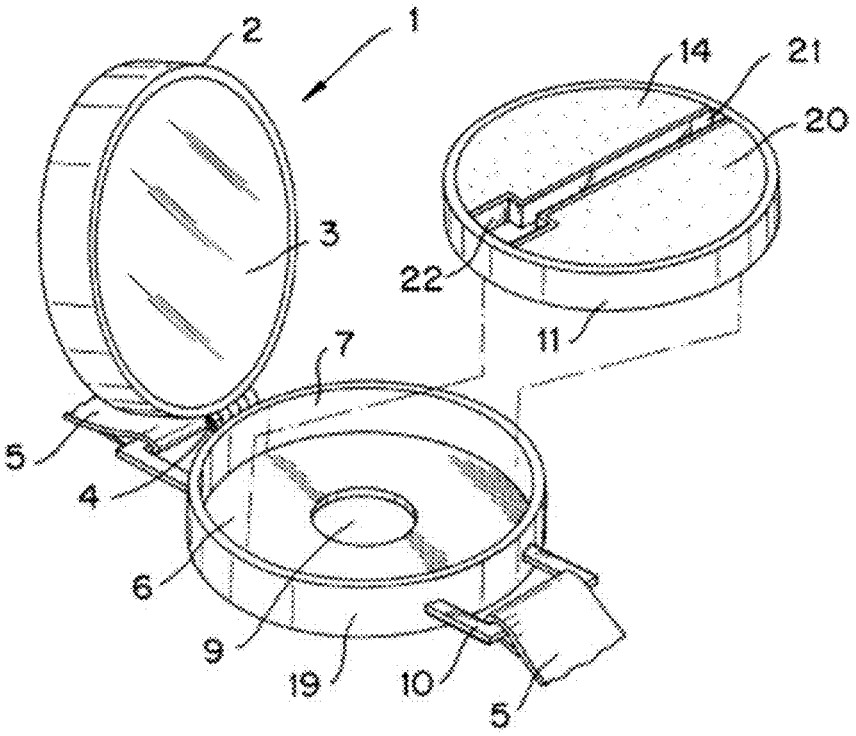
FIG. 20 Prior Art
FIG. 20 shows yet another prior art construct.
Figure 21:
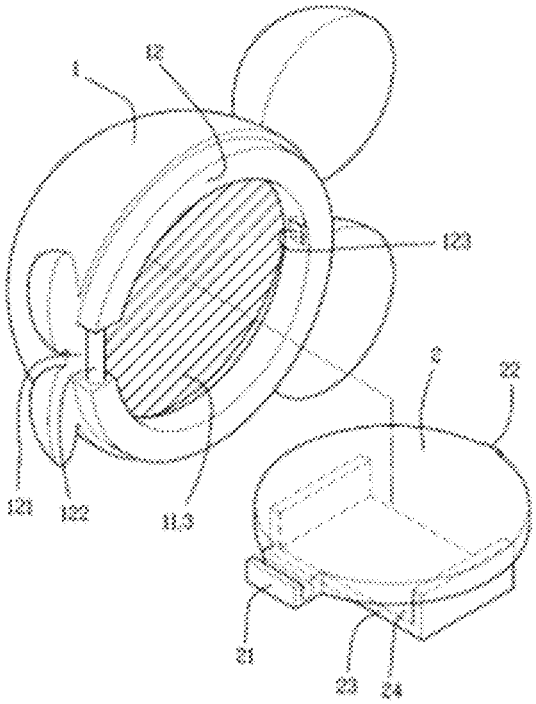
FIG. 21 Prior Art
FIG. 21 shows yet another prior art construct.
Figure 22:
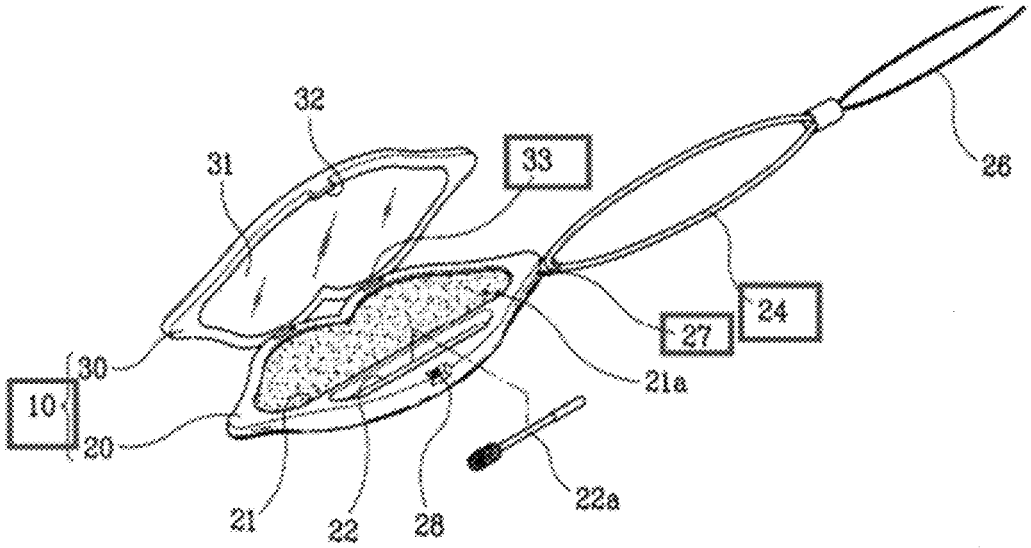
FIG. 22 Prior Art
FIG. 22 shows yet another prior art construct.

The figures herein are for illustrative purposes only and are not necessarily drawn to scale.

DETAILED DESCRIPTION OF THE EXAMPLE EMBODIMENTS

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant application should not be treated as such and should not be read as defining any terms appearing in the accompanying claims. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Where a range is expressed, a further embodiment includes from the one particular value and/or to the other particular value. The recitation of numerical ranges by endpoints includes all numbers and fractions subsumed within the respective ranges, as well as the recited endpoints. Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure. For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

As used herein, the singular forms "a", "an", and "the" include both singular and plural referents unless the context clearly dictates otherwise.

As used herein, "about," "approximately," "substantially," and the like, when used in connection with a measurable variable such as a parameter, an amount, a temporal duration, and the like, are meant to encompass variations of and from the specified value including those within experimental error (which can be determined by e.g. given data set, art accepted standard, and/or with e.g. a given confidence interval (e.g. 90%, 95%, or more confidence interval from the mean), such as variations of +/−10% or less, +/−5% or less, +/−1% or less, and +/−0.1% or less of and from the specified value, insofar such variations are appropriate to perform in the disclosure. As used herein, the terms "about," "approximate," "at or about," and "substantially" can mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

The term "optional" or "optionally" means that the subsequent described event, circumstance or substituent may or may not occur, and that the description includes instances where the event or circumstance occurs and instances where it does not.

As used herein, "polymer" refers to molecules made up of monomers repeat units linked together. "Polymers" are understood to include, but are not limited to, homopolymers, copolymers, such as for example, block, graft, random and alternating copolymers, terpolymers, etc. and blends and modifications thereof "A polymer" can be can be a three-dimensional network (e.g. the repeat units are linked together left and right, front and back, up and down), a two-dimensional network (e.g. the repeat units are linked together left, right, up, and down in a sheet form), or a one-dimensional network (e.g. the repeat units are linked left and right to form a chain). "Polymers" can be composed, natural monomers or synthetic monomers and combinations thereof. The polymers can be biologic (e.g. the monomers are biologically important (e.g. an amino acid), natural, or synthetic.

As used interchangeably herein, the terms "sufficient" and "effective," can refer to an amount (e.g. mass, volume, dosage, concentration, and/or time period) needed to achieve one or more desired and/or stated result(s). For example, a therapeutically effective amount refers to an amount needed to achieve one or more therapeutic effects.

As used herein, "tangible medium of expression" refers to a medium that is physically tangible or accessible and is not a mere abstract thought or an unrecorded spoken word. "Tangible medium of expression" includes, but is not limited to, words on a cellulosic or plastic material, or data stored in a suitable computer readable memory form. The data can be stored on a unit device, such as a flash memory or CD-ROM or on a server that can be accessed by a user via, e.g. a web interface.

As used herein, the terms "weight percent," "%," and "wt. %," which can be used interchangeably, indicate the percent by weight of a given component based on the total weight of a composition of which it is a component, unless otherwise specified. That is, unless otherwise specified, all wt % values are based on the total weight of the composition. It should be understood that the sum of wt % values for all components in a disclosed composition or formulation are equal to 100. Alternatively, if the wt % value is based on the total weight of a subset of components in a composition, it should be understood that the sum of wt % values the specified components in the disclosed composition or formulation are equal to 100.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s). Reference throughout this specification to "one embodiment", "an embodiment," "an example embodiment," means that a particular feature, structure or characteristic described in connection with the embodiment is included in at least one embodiment of the present disclosure. Thus, appearances of the phrases "in one embodiment," "in an embodiment," or "an example embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the disclosure. For example, in the appended claims, any of the claimed embodiments can be used in any combination.

All patents, patent applications, published applications, and publications, databases, websites and other published materials cited herein are hereby incorporated by reference to the same extent as though each individual publication, published patent document, or patent application was specifically and individually indicated as being incorporated by reference.

Kits

Any of the wrist palettes described herein can be provided as a combination kit. As used herein, the terms "combination kit" or "kit of parts" refers to the parts, components, compositions, and any additional items that are used to package, sell, market, deliver, and/or provide the combination of parts or a single construct, contained therein. Such additional components include, but are not limited to, packaging, containers, blister packages, and the like. When one or more of the parts, components, compositions described herein are provided, or a combination thereof are provided (e.g., parts that may be assembled into a wrist palette or interchangeable parts that may be provided simultaneously) the combination kit can provide the wrist palette in a single construct (e.g., a completely assembled wrist palette) or in separate constructs (e.g., a wrist palette construct requiring assembly of partially assembled constructs). When the parts, components, compositions, and any additional items described herein or a combination thereof and/or kit components are not provided simultaneously, the combination kit can contain each part or other component in separate combinations. The separate kit components can be contained in a single package or in separate packages within the kit.

In some embodiments, the combination kit also includes instructions printed on or otherwise contained in a tangible medium of expression. The instructions can provide information regarding the content of the package, safety information regarding the content of the package, information regarding assembly and/or interchanging parts, indications for use, and/or recommended uses/assemblies contained therein. In some embodiments, the instructions can provide directions and protocols for using the wrist palette described herein to a user. In some embodiments, the instructions can provide one or more embodiments of the methods for assembling or interchanging a wrist palette of the current disclosure such as any of the methods described in greater detail elsewhere herein.

The wrist palettes of the current disclosure may have both the container and clip both lay flat and the top of the container molded into the shape of lips or other aesthetically pleasing designs, such as cartoon characters, symbols, geometric shapes, etc. The bottom side of clip on the wrist palette may be slightly contoured w/very small grooves applied. The inside has a separate lip shaped mold for lipstick. Magnets are located on each side (inside) for easy opening and closing and there's a small indention in center front of the lip for the finger to easily lift top of container to use. The clip and container are one piece and clip has small hinge for opening and attaching to wearable items. The wrist palette is made with environmentally friendly plastic and covered with stick on design and stick on mirror.

The wrist palette allows you to take it with you no matter where you go. No need for a handbag or something with pockets to hold your lipstick. Because of the flat, sleek contour of the container and clip it is appealing to the eye and can be attached to many different items. It is not bulky and you do not have to look through a purse or container to find it as it is affixed to you. Nor do you have to ask a friend or husband to carry it around for you. It is also perfect for touch ups when you are out and about.

Figure 23:
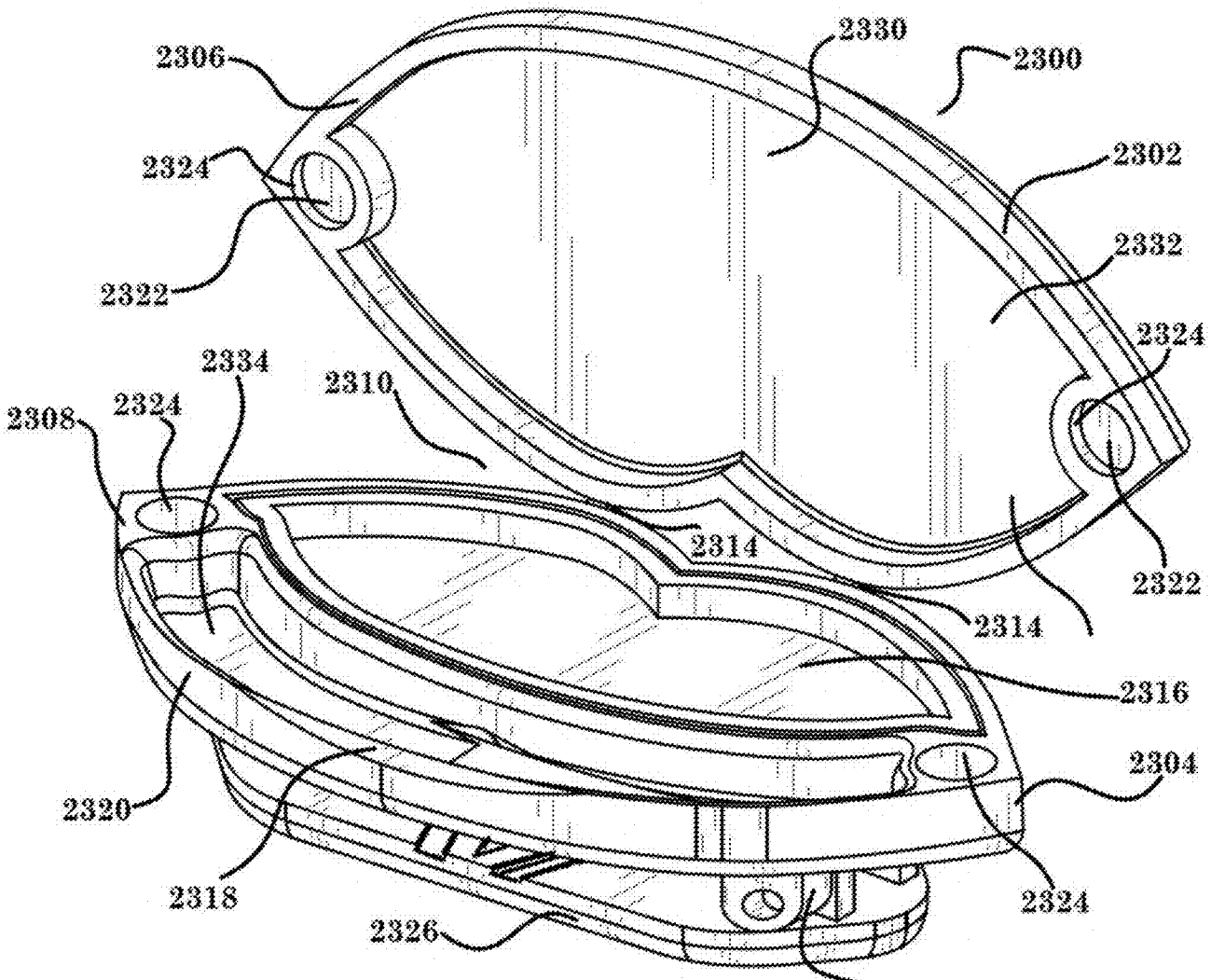
FIG. 23 shows one embodiment of a wrist palette of the current disclosure in an open configuration.

FIG. 23 shows one embodiment of a wrist palette 2300. Wrist palette 2300 includes a outer cover 2302, which may be made from plastics, polymers, metals, synthetics, etc., and may be formed in a multitude of shapes, in one instance outer cover 2302 may be formed into the shape of human lips. Cover 2302 and container 2304 may be formed to have complementary shapes to one another, such as container 2304 also being formed in a human lip shape so that cover perimeter 2306 and container perimeter 2308 are the same shape. Cover 2302 and container 2304 may be formed to be separable from one another, such that a user may "mix and match" different styles of cover 2302 with container 2304 to allow for a multitude of fashion configurations. This allows wrist palette 2300 to move from open position 2310 to closed position 2312, see FIG. 30, via hinges 2314, which may be mechanical hinges or flexible hinges formed from materials that deform and reform to allow opening and closing of cover 2302 onto container 2304 and seal together so that the contents of wrist palette 2300 do not escape or leak from within content holder 2316. Hinges 2314 may be formed from the same material as wrist palette 2300 or from a separate material and may be integral to wrist palette 2300 or a separate hinge affixed to cover 2302 and container 2304. Wrist palette 2300 may also define indention 2318 into outer rim 2320 of wrist palette 2300 to allow a user to insert a fingernail or other object into indention 2318 to lift and separate cover 2302 from container 2304. Cover 2302 and container 2304 may be sealed together via magnets 2322 secured within magnet orifices 2324. These magnets may be ferrite magnets, Neodymium Iron Boron (NdFeB) magnets, Samarium cobalt magnets, and/or Aluminum Nickel Cobalt (AlNiCo) magnets and may be glued, heat-formed, or held into place in magnet orifices 2324 via frictional engagement. Wrist palette 2300 may also include attachment clip 2326. Attachment clip 2326 serves to affix write palette 2300 into place on a wearer's clothes, purse strap, bra strap, pocket opening, watch band, etc., via attachment clip 2326 being able to open and close via attachment clip hinge 2328, which may be a spring biased hinge. Further, attachment clip 2326 may also be formed to be separated from and rejoined to container 2304 to also allow a user to "mix and match" various attachment clip 2326 and container 2304 styles and designs. Wrist palette 2300 may also include mirror 2330 on cover underside 2332 to allow a user to be able to see themselves while applying make-up, lipstick, etc., contained within content holder 2316. This may include lip gloss, lip stick, lip stain, lip color, lip liner, as well as other types of make-up, creams, and powders, etc. Wrist palette 2300 may also include storage chamber 2334 that may hold applicator brushes, pencil liners, lip brushes, sponge tips, other applicators, etc.

Figure 24:
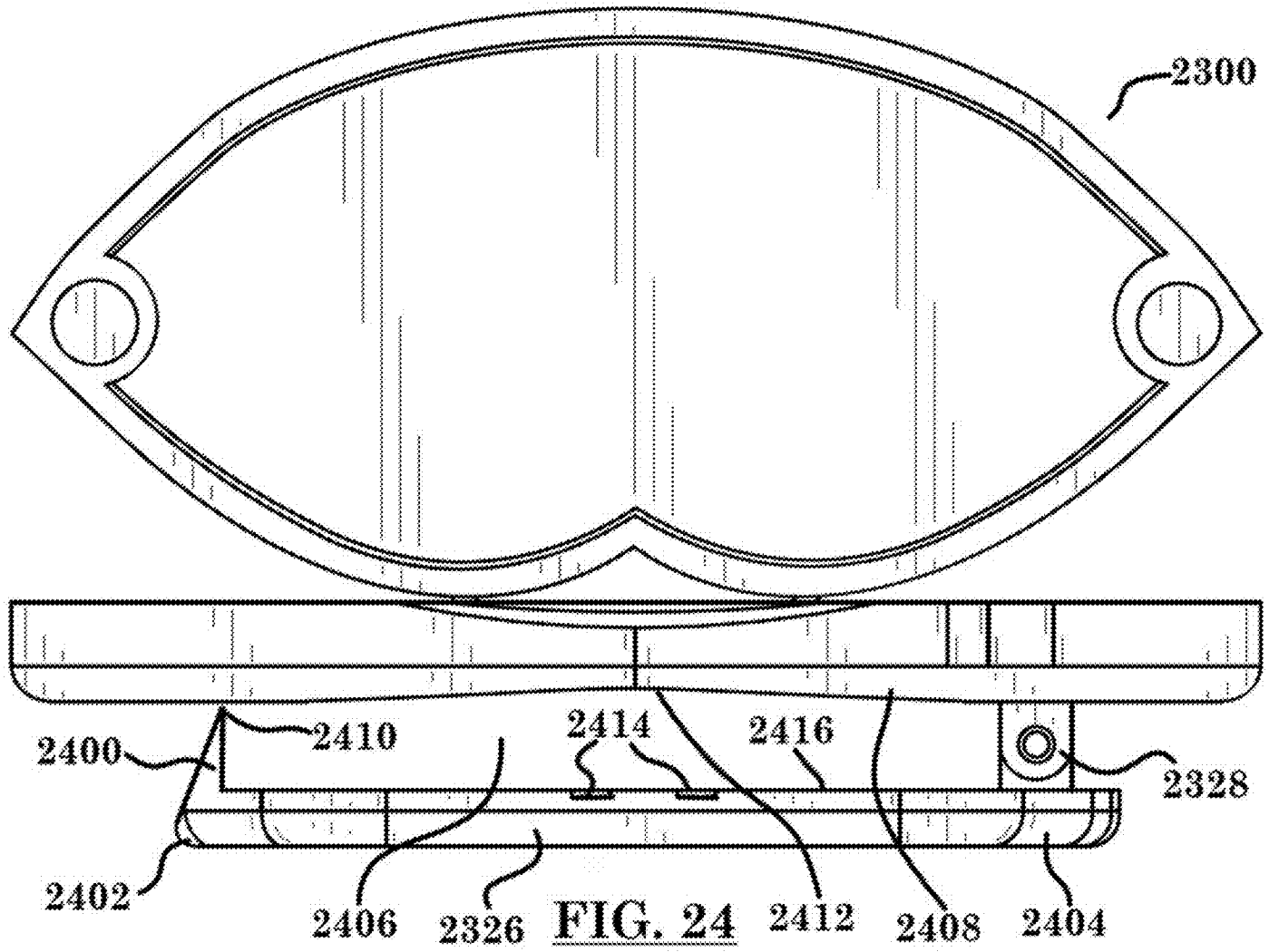
FIG. 24 shows a front view of one embodiment of a wrist palette of the current disclosure.

With respect to FIG. 24, attachment clip 2326 defines attachment hook 2400, which may be formed on or near distal end of attachment hook 2402 opposite attachment hinge 2328 formed on or near proximal end of attachment hook 2404, which may in one instance comprise an attachment lever with a grasping end. Attachment clip 2326 defines first attachment chasm 2406 between itself and container bottom 2408. First attachment chasm 2406 and attachment hook 2400 provide wrist palette 2300 with multiple ways to attach to a user or the user's clothing, purse, etc. For instance, the user may pass a strap, such as a purse, or if the user wants to keep wrist palette 2300 hidden from view, a bra strap, between attachment clip 2326 and container bottom 2408, situating strap 2500, see FIG. 25 within first attachment chasm 2406 so that strap 2500 lies captured between attachment clip 2326 and container bottom 2408. This configuration allows wrist palette 2300 to reposition, via sliding, placing in new location via removal, etc., up and down the strip and affixing to same by simply opening attachment clip 2326 via attachment hinge 2328. Further, attachment hook 2400 may also be used to affix wrist palette 2300 to a wearer. Attachment hook 2400 may be used to grasp the interior or exterior of a user's shirt pocket, pants pocket, a bunched section of a shirt, skirt, pants, etc., with attachment hook 2400 finding purchase in those materials. Indeed, attachment hook 2400 can even be placed in the user's hair and worn like a clip or barrette. While attachment hook 2400 is shown with attachment hook end 2410 formed as a sharpened point, other configurations are considered within the scope of the disclosure and attachment hook end may be formed as rounded, squared, oblong, etc., in order to provide different types of purchase on different surfaces/objects. Further, container bottom 2408 may define container bottom indention 2412 in the lower, outer surface of the container that allows wrist palette 2400 to have a clothing strap, watch band, purse strap, etc., next within container bottom indention 2412. While shown as a gentle slope, container bottom indention 2412 is also not limited to this configuration but may form angled, rounded, irregular shaped, specifically shaped indentions to accommodate rounded, square, oblong, etc. items to be secured between attachment clip 2326 and container bottom 2408. Further, attachment clip 2326 may define attachment clip grooves 2414 in attachment clip upper surface 2416. Attachment clip grooves 2414 provide additional purchase/frictional engagement on items passing within first attachment chasm 2406 and contacting attachment clip upper surface 2416, such as a clothing strap, watch band, purse strap, etc., passing through first attachment chasm 2406 and touching or held against attachment clip upper surface 2416 and/or container bottom 2408. Clip upper surface 2416 may also "arch" or bend toward container bottom indention 2412 to provide further or improved frictional engagement.

Figure 25:
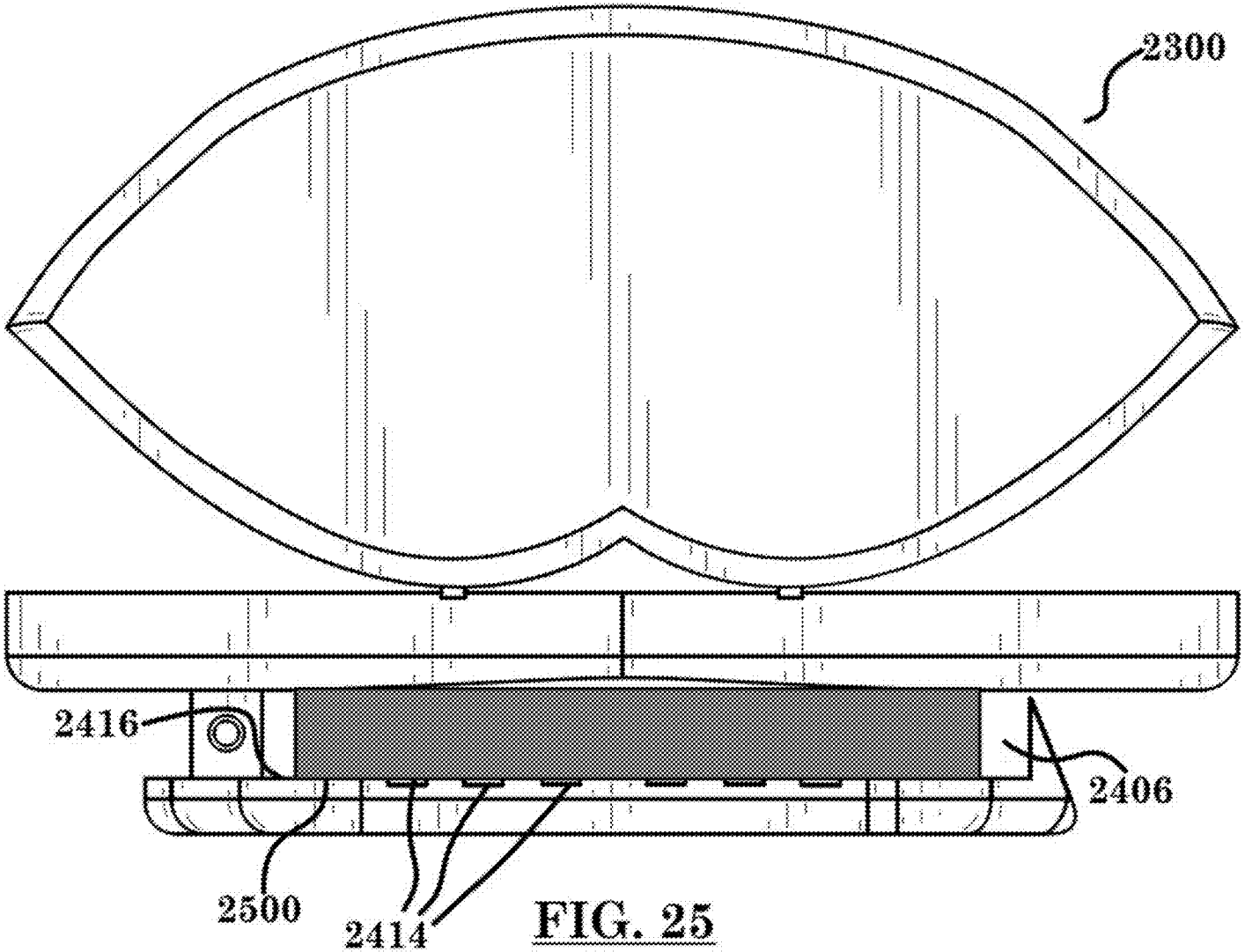
FIG. 25 shows a back view of one embodiment of a wrist palette of the current disclosure.
Figure 26:
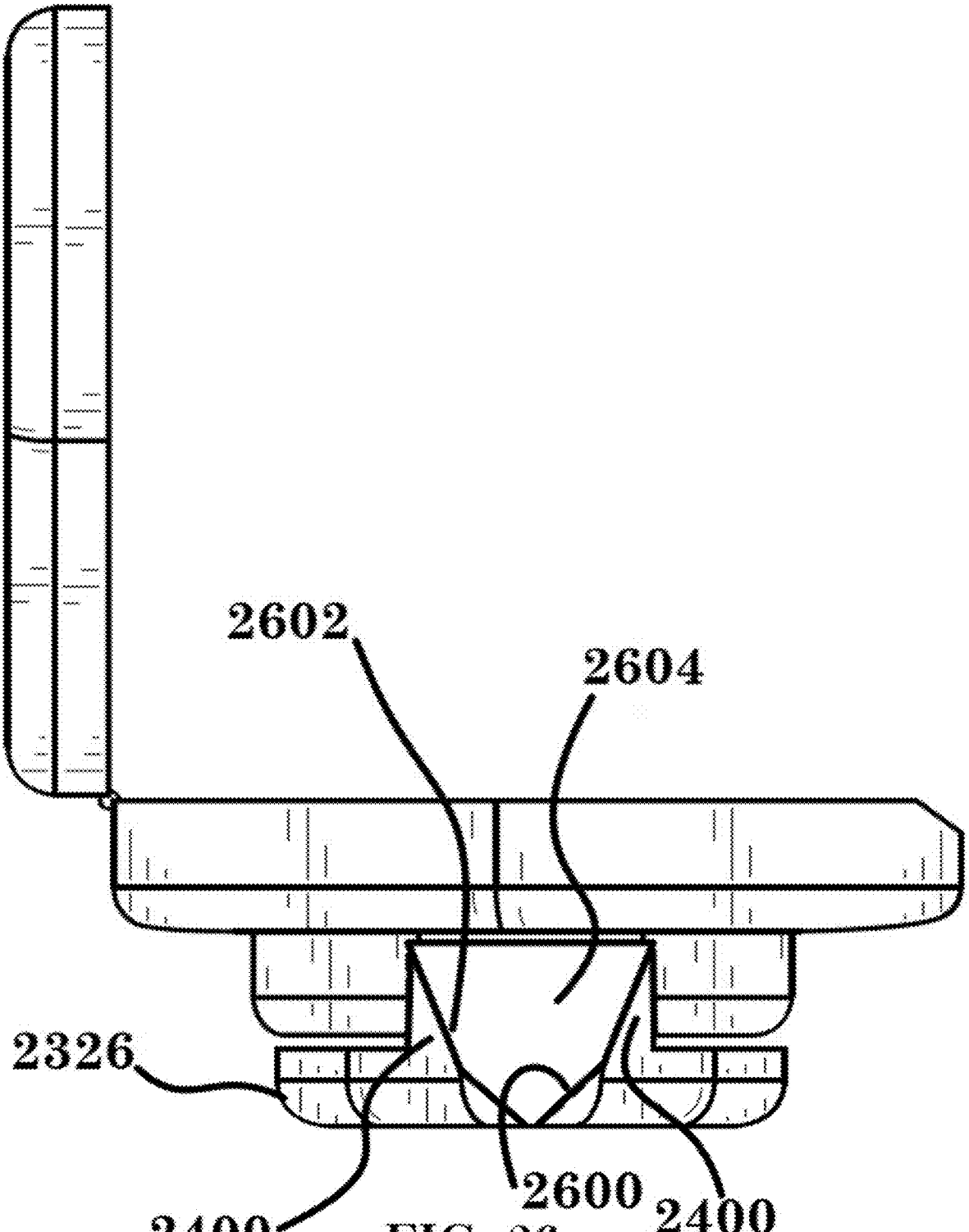
FIG. 26 shows a right side view of one embodiment of a wrist palette of the current disclosure.
Figure 27:
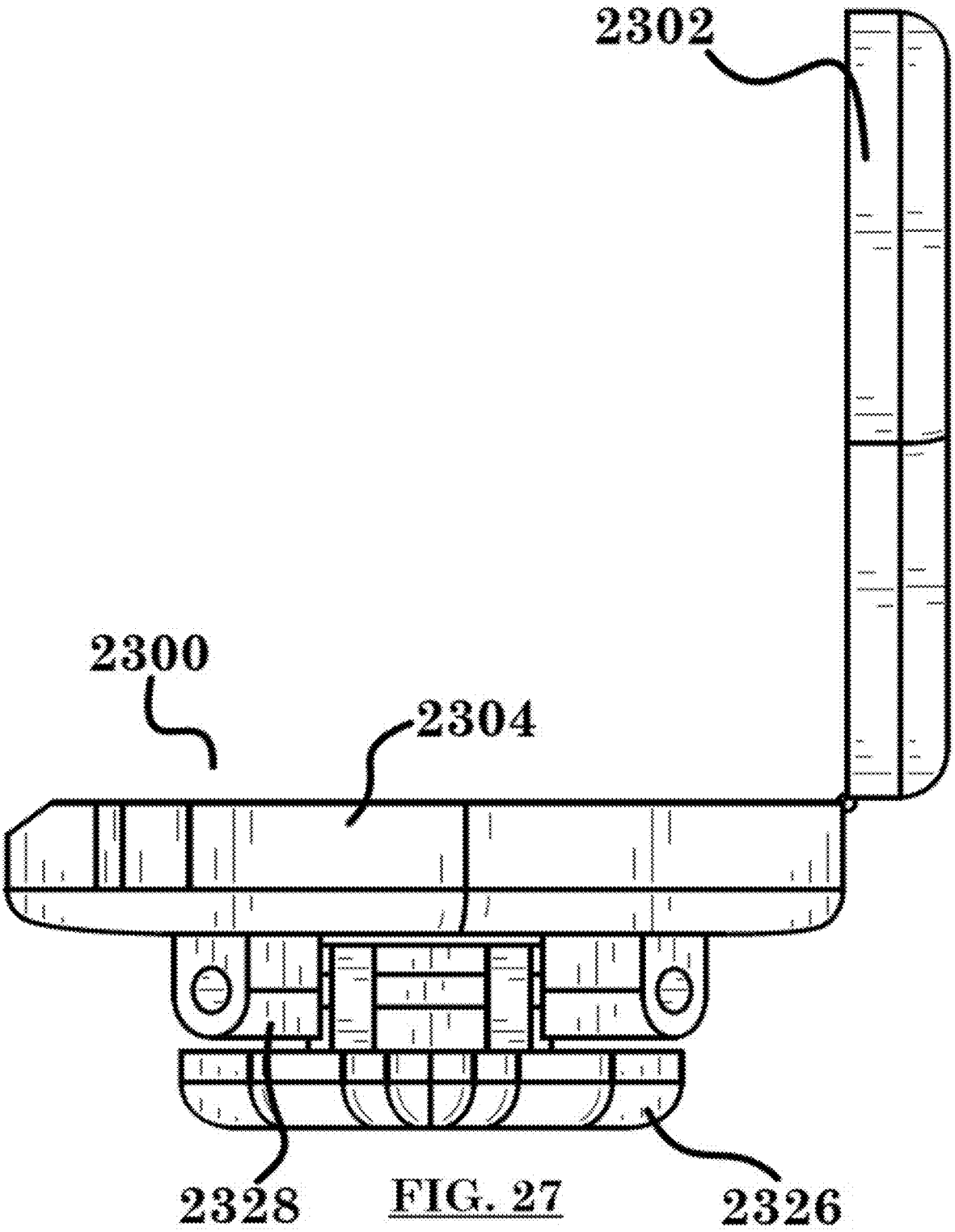
FIG. 27 shows a left side view of one embodiment of a wrist palette of the current disclosure.
Figure 28:
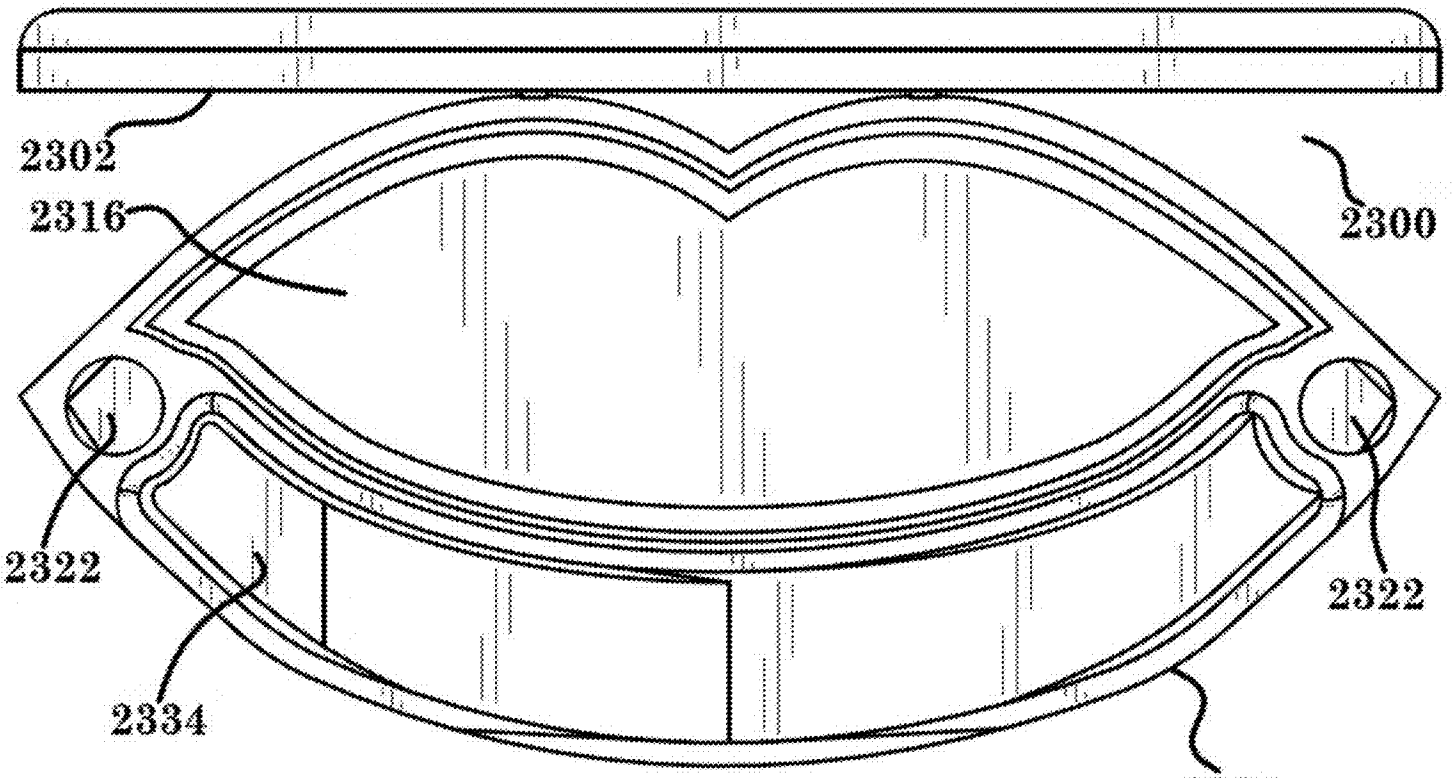
FIG. 28 shows an interior view of one embodiment of a wrist palette of the current disclosure.
Figure 29:
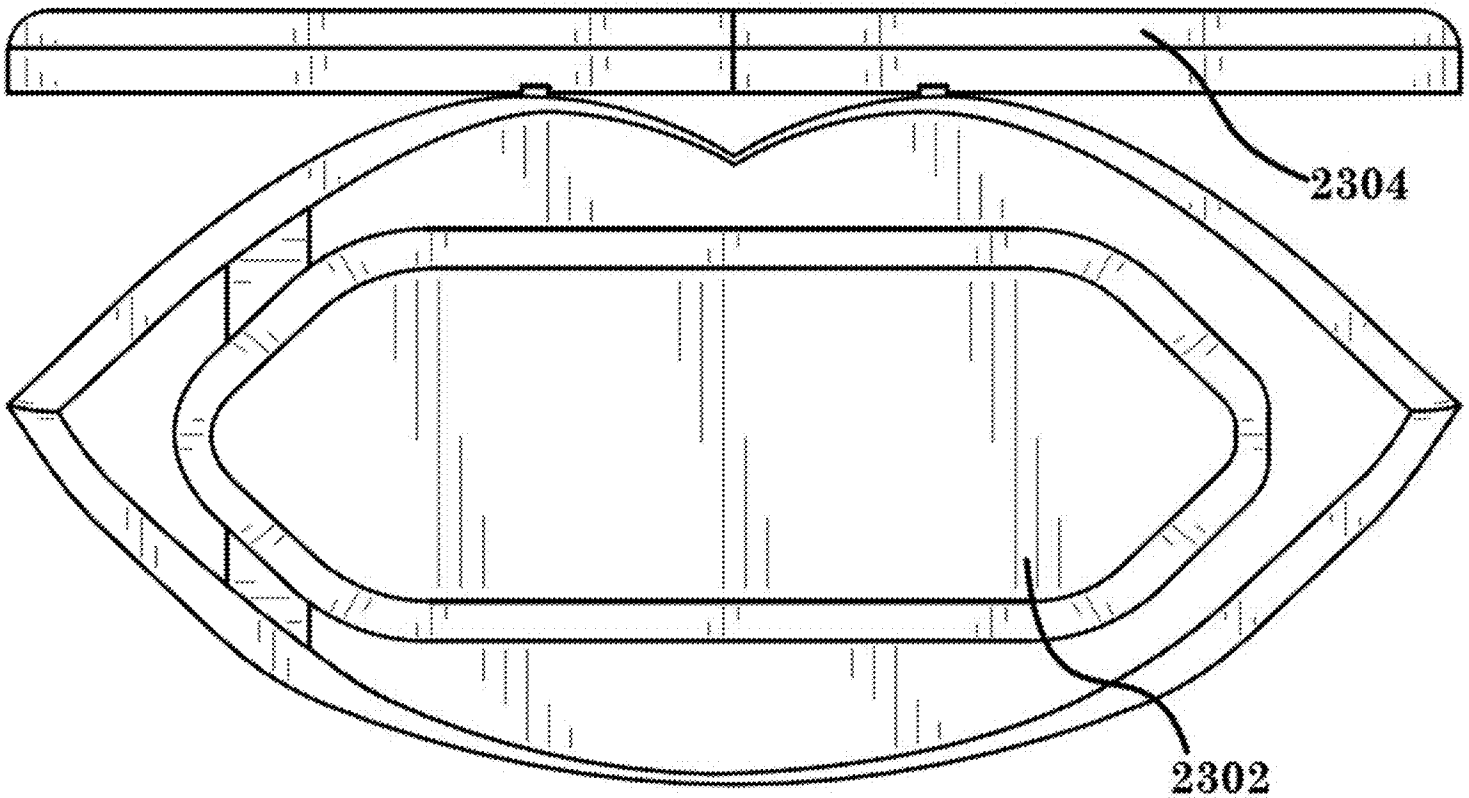
FIG. 29 shows a bottom exterior view of one embodiment of a wrist palette of the current disclosure.
Figure 30:
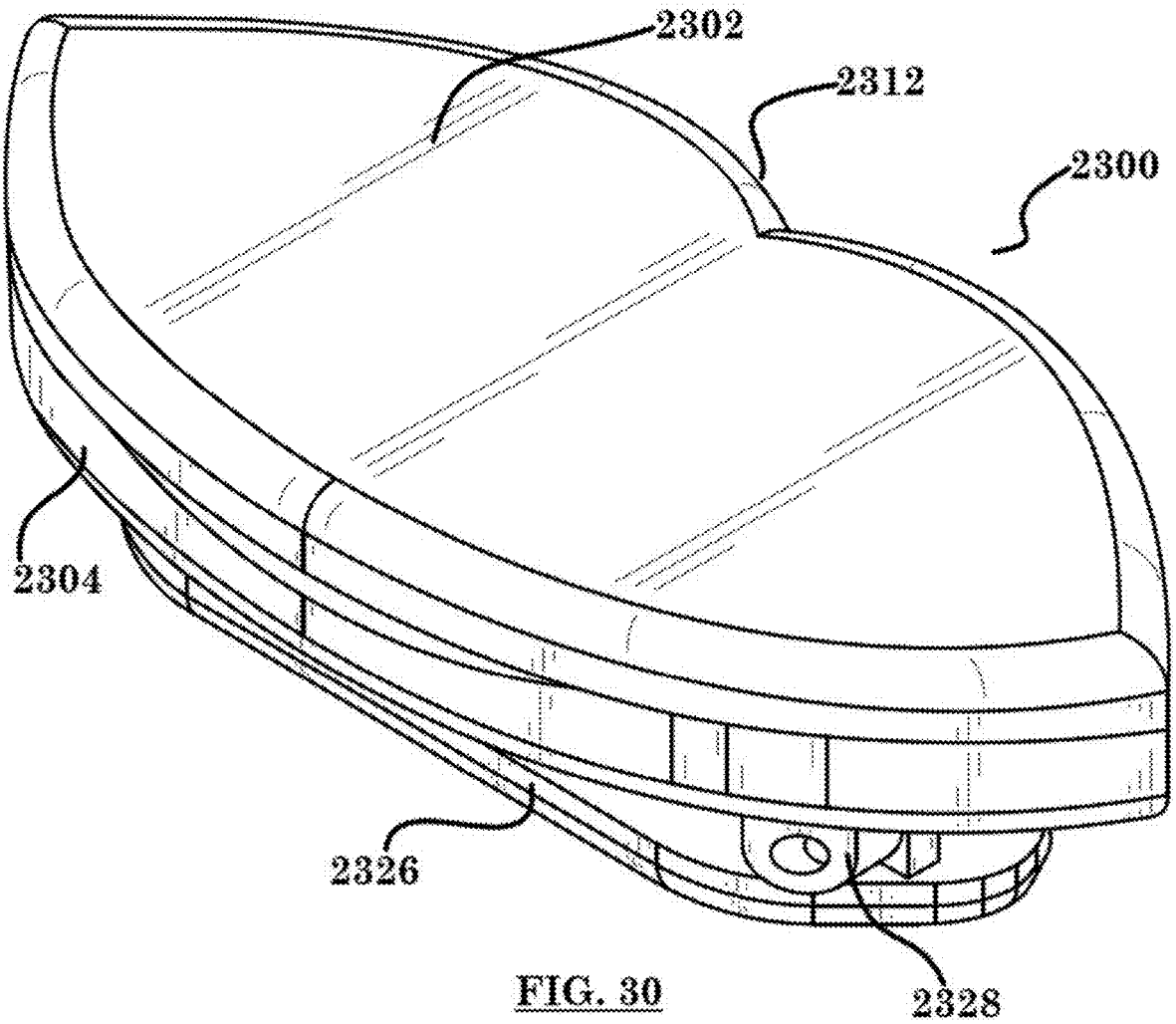
FIG. 30 shows one embodiment of a wrist palette of the current disclosure in a closed configuration in a top down view.

FIG. 25 shows a back view of one embodiment of wrist palette 2300 of the current disclosure with multiple attachment clip grooves 2414 defined in attachment clip upper surface 2416 and strap 2500 contained within first attachment chasm 2406. FIG. 26 shows a right side view of one embodiment of wrist palette 2300 of the current disclosure. FIG. 26 also shows that multiple attachment hooks 2400 may be defined on attachment clip 2326 and that attachment clip inner surface 2600 may be variously shaped, such as the angled cleft 2602 shown, to better engage items held onto by wrist palette 2300 via engagement with second engagement chasm 2604, which in this case runs essentially perpendicular to first attachment chasm 2406, not shown. However, second engagement chasm 2604 is not limited to the shape and orientation shown herein and other shapes/configurations are considered disclosed as part of this disclosure. FIG. 27 shows a left side view of one embodiment of wrist palette 2300 of the current disclosure. FIG. 28 shows an interior view of one embodiment of wrist palette 2300 of the current disclosure. FIG. 29 shows a bottom exterior view of one embodiment of wrist palette 2300 of the current disclosure. FIG. 30 shows one embodiment of wrist palette 2300 of the current disclosure in a closed position 2312 from a top down view.

Figure 31:
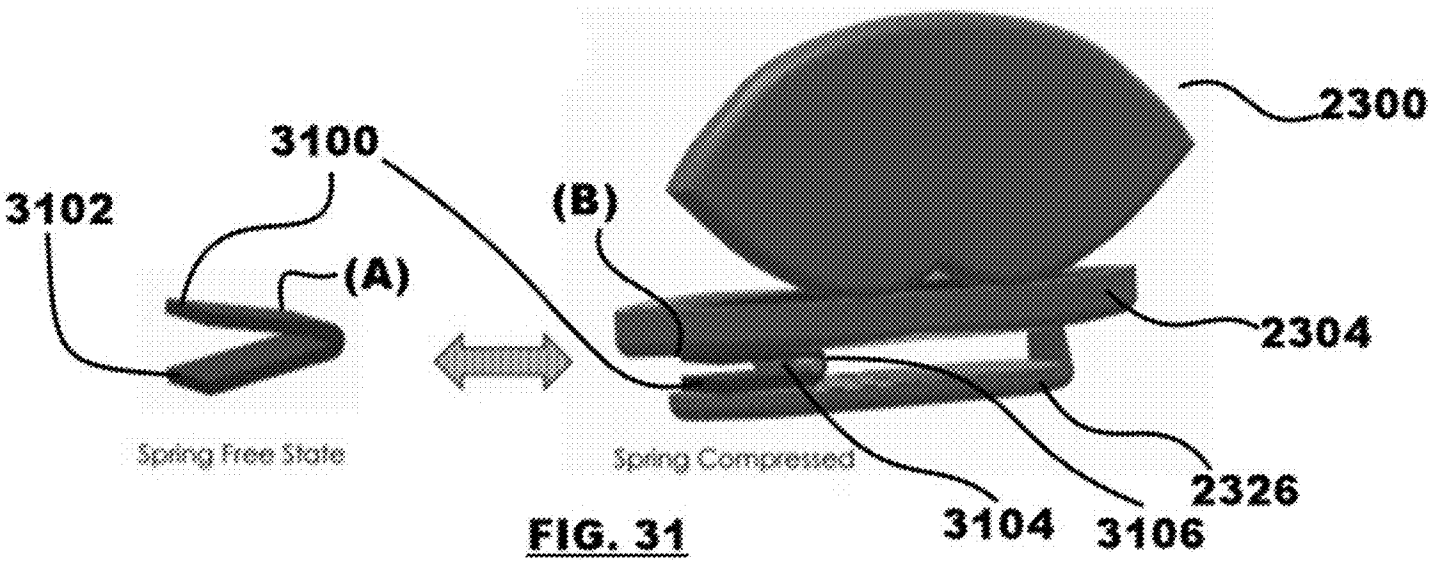
FIG. 31 shows a further embodiment of a wrist palette of the current disclosure including a compression spring.

FIG. 31 shows a further embodiment of the current disclosure including a compression spring 3100. Spring 3100 is shown as a rounded, 'V' shaped maleable strip 3102 that may be placed within wrist palette 2300 to allow attachment clip 2326 to open and close with minimal effort from the user. Spring 3100 may be formed from metal, plastic, thermoformed plastic, rubber, or any other suitable material and may be affixed to both attachment clip 2326 and container 2304 via adhesives, heat bonding, 3-D printing, etc. The material forming spring 3100 should not only be flexible and durable enough to move between spring free state (A) and spring compressed state (B) and being further compressed from spring compressed state (B) to open attachment clip 2326 but should also possess material "memory" so that spring 3100 returns to its original shape after being compressed to open attachment clip 2326. Spring 3100 may also be formed or "bent" around spring pivot 3104 inserted within spring fold 3106 to help maintain the shape and resilience of spring 3100 and prevent spring 3100 from being compressed entirely flat, such as by being sat upon in a user's pocket or compressed by a heavy object placed atop wrist palette 2300. Spring pivot 3104 may be formed from the same materials as spring 3100 or different materials and may be wedged, fused, adhered, or otherwise attached within spring fold 3106 to remain in place and prevent complete compression of spring 3100. While shown as a rounded 'V' shape, other shapes are considered suitable for the spring and the current disclosure should not be considered limiting.

Various modifications and variations of the described methods, pharmaceutical compositions, and kits of the disclosure will be apparent to those skilled in the art without departing from the scope and spirit of the disclosure. Although the disclosure has been described in connection with specific embodiments, it will be understood that it is capable of further modifications and that the disclosure as claimed should not be unduly limited to such specific embodiments. Indeed, various modifications of the described modes for carrying out the disclosure that are obvious to those skilled in the art are intended to be within the scope of the disclosure. This application is intended to cover any variations, uses, or adaptations of the disclosure following, in general, the principles of the disclosure and including such departures from the present disclosure come within known customary practice within the art to which the disclosure pertains and may be applied to the essential features herein before set forth.

What is claimed is:

1. A wrist palette comprising:

a shaped outer cover defining at least one first shape;

a container attached to and covered by the shaped outer cover;

the container defining at least one second shape that is complementary to the at least one first shape defined by the shaped outer cover, wherein the container includes a lower, outer surface having a bottom indentation;

wherein the shaped outer cover and the container are affixed to one another via at least one hinge and move from a closed position to an open position as well as move from the open position to the closed position;

at least one attachment clip affixed to the lower, outer surface of the container; and the at least one attachment clip configured to move from a first position engaging the lower, outer surface of the container to a second position distanced from the lower, outer surface of the container and configured to return to the first position from the second position, wherein the bottom indentation is configured to accommodate an item secured between the attachment clip and the lower, outer surface.

2. The wrist palette of claim 1, wherein the shaped outer cover is formed in the shape of a stylized human lip.

3. The wrist palette of claim 1, wherein the container defines at least one storage container within the container.

4. The wrist palette of claim 3, wherein the storage container is formed in the same shape as the container.

5. The wrist palette of claim 1, wherein the at least one attachment clip defines at least one attachment first engagement chasm between the at least one attachment clip and the lower, outer surface of the container.

6. The wrist palette of claim 5, wherein the attachment clip defines a second engagement chasm positioned substantially perpendicular to the first engagement chasm.

7. The wrist palette of claim 1, wherein the at least one attachment clip defines at least one attachment hook on a distal end of the attachment clip.

8. The wrist palette of claim 1, wherein a spring is placed between the at least one attachment clip and the lower, outer surface of the container.

9. The wrist palette of claim 8, wherein the spring is a rounded 'V' shaped spring.

10. A method of forming a wrist palette comprising:

forming a shaped outer cover defining at least one first shape;

forming a container attached to and covered by the shaped outer cover, wherein the container is formed to includes a lower, outer surface having a bottom indentation;

forming the container to define at least one second shape that is complementary to the at least one first shape defined by the shaped outer cover;

forming the shaped outer cover and the container affixed to one another via at least one hinge and configuring the shaped outer cover and the container to move from a closed position to an open position as well as move from the open position to the closed position;

forming at least one attachment clip and affixing the at least one attachment clip to the lower, outer surface of the container; and configuring the at least one attachment clip to move from a first position engaging the lower, outer surface of the container to a second position distanced from the lower, outer surface of the container and configured to return to the first position from the second position, wherein the bottom indentation is formed as sloped surfaces that extend outward away from a center location on the lower, outer surface toward sides of the container and to accommodate an item secured between the attachment clip and the lower, outer surface.

11. The method of forming a wrist palette of claim 10, further comprising forming the shaped outer cover in the shape of a stylized human lip.

12. The method of forming a wrist palette of claim 10, further comprising forming the container to define at least one storage container within the container.

13. The method of forming a wrist palette of claim 12, further comprising forming the storage container in the same shape as the container.

14. The method of forming a wrist palette of claim 10, further comprising forming the at least one attachment clip to define at least one attachment first engagement chasm between the at least one attachment clip and the lower, outer surface of the container.

15. The method of forming a wrist palette of claim 14, further comprising forming the attachment clip to define a second engagement chasm positioned substantially perpendicular to the first engagement chasm.

16. The method of forming a wrist palette of claim 10, further comprising forming the at least one attachment clip to define at least one attachment hook on a distal end of the attachment clip.

17. The method of forming a wrist palette of claim 10, further comprising placing a spring between the at least one attachment clip and the lower, outer surface of the container.

18. The wrist palette of claim 1, wherein the bottom indentation comprises sloped surfaces that extend outward away from a center location on the lower, outer surface toward sides of the container.

19. The wrist palette of claim 18, wherein the attachment clip includes at least two clip grooves on a side facing the lower, outer surface of the container and centered on the bottom indentation, the at least two clip grooves are configured to provide frictional engagement with an item secured between the attachment clip and the lower, outer surface.

20. The method of forming a wrist palette as recited in claim 10, further comprising forming the attachment clip to include at least two clip grooves on a side facing the lower, outer surface of the container and centered on the bottom indentation, and forming the at least two clip grooves to provide frictional engagement with an item secured between the attachment clip and the lower, outer surface.

* * * * *